US010634465B2

(12) United States Patent
Laporte et al.

(10) Patent No.: US 10,634,465 B2
(45) Date of Patent: Apr. 28, 2020

(54) MACHINE FOR LAUNCHING TARGETS WITH IMPROVED BARREL

(71) Applicant: LAPORTE HOLDING (SAS), Biot (FR)

(72) Inventors: Jean-Michel Laporte, Biot (FR); Jean-Marc Fouques, Antibes (FR)

(73) Assignee: LAPORTE HOLDING (SAS), Biot (FR)

( * ) Notice: Subject to any disclaimer, the term of this patent is extended or adjusted under 35 U.S.C. 154(b) by 0 days.

(21) Appl. No.: 16/069,664

(22) PCT Filed: Jan. 11, 2017

(86) PCT No.: PCT/EP2017/050489
§ 371 (c)(1),
(2) Date: Dec. 14, 2018

(87) PCT Pub. No.: WO2017/121761
PCT Pub. Date: Jul. 20, 2017

(65) Prior Publication Data

US 2019/0093994 A1 Mar. 28, 2019

(30) Foreign Application Priority Data

Jan. 12, 2016 (FR) ..... 16 50229

(51) Int. Cl.
*F41J 9/18* (2006.01)
*F41J 9/30* (2006.01)

(52) U.S. Cl.
CPC ..... *F41J 9/30* (2013.01)

(58) Field of Classification Search
CPC ..... F41J 9/18; F41J 9/30
See application file for complete search history.

(56) References Cited

U.S. PATENT DOCUMENTS

| | | | | |
|---|---|---|---|---|
| 2,677,361 A | | 5/1954 | Mcintire | |
| 2,827,036 A | * | 3/1958 | Ervine | F41J 9/30 124/47 |
| 2,989,045 A | | 6/1961 | Hodge et al. | |
| 2,996,058 A | * | 8/1961 | Ervine | F41J 9/30 124/8 |
| 3,621,828 A | * | 11/1971 | Hansen | F41J 9/30 124/8 |
| 6,431,161 B1 | * | 8/2002 | Gustafsson | F41J 9/30 124/8 |
| 6,588,410 B1 | * | 7/2003 | Graber | F41J 9/24 124/8 |

FOREIGN PATENT DOCUMENTS

| | | |
|---|---|---|
| DE | 29 52 527 | 7/1981 |
| FR | 2 688 056 | 9/1993 |
| FR | 2 709 543 | 3/1995 |
| SU | 612 686 | 6/1978 |

* cited by examiner

*Primary Examiner* — John A Ricci
(74) *Attorney, Agent, or Firm* — Hauptman Ham, LLP

(57) ABSTRACT

Machine for launching targets comprising a frame on which a mounting is assembled, relative to which a barrel is rotatably assembled according to an axis of rotation and in a direction of rotation. The barrel comprising a plurality of columns for storing stacks of targets, the storage columns being arranged according to a ring defining an inner surface of the barrel. The inner space of the barrel advantageously comprises at least one additional target storage element.

19 Claims, 3 Drawing Sheets

MACHINE FOR LAUNCHING TARGETS WITH IMPROVED BARREL

FIELD OF THE INVENTION

This invention in particular relates to a machine for launching targets and specifically to the device for storing the targets of such a machine.

One preferred application concerns the shooting sports industry and more specifically the clay pigeon shooting industry.

TECHNOLOGICAL BACKGROUND

In the above field, managers of clay pigeon shooting clubs automatise their shooting range in order to reduce operating costs. However, some actions are difficult to reduce or modify. For example, loading the targets into the machines takes time, during which the installation must placed out of service; this time varies depending on the number of machines and the relative position thereof. Document FR1462607 discloses a machine for launching targets incorporating a mounting and a barrel assembled such that it rotates on the mounting. The periphery of the barrel comprises columns in which targets to be launched are stacked. The capacity of the barrels varies as a function of the height and number of the columns. In the end, the number of targets loaded into a launching machine is limited by a plurality of factors. The height is thus limited by the capacity of the lowest-lying target to remain undamaged. More specifically, the friction generated by the barrel's moving phases, in addition to the vibrations produced by the shots are accentuated by the weight of the stack supported by said target.

Moreover, the diameter of the barrel cannot be significantly increased. The weight of each stack of targets generates friction. The further said friction forces are from the centre by increasing the number of columns, the greater the resistive torque opposing the rotation of the barrel, which thus requires an increasingly powerful motor. Furthermore, the distance covered by the lowest-lying target increases, which multiplies the risks of damage.

Moreover, problems involving the strength of the targets, which is another, highly-restrictive constraint, limits development possibilities. Most disciplines impose closed structures for housing the machines, the dimensions whereof are inflexible.

There is thus a need to create a machine for launching targets having standard dimensions with an increased target storage capacity.

The invention overcomes all or part of the current technical disadvantages.

SUMMARY OF THE INVENTION

One feature of the invention relates in particular to a machine for launching targets comprising a frame on which a mounting is assembled, relative to which a barrel is rotatably assembled according to an axis of rotation and in a direction of rotation, said barrel comprising a plurality of target storage columns for storing stacks of targets, the storage columns being preferably non-moving relative to one another and arranged according to a ring defining an inner space of the barrel.

The inner space of the barrel advantageously comprises at least one additional target storage element.

This advantageous characteristic allows the number of targets present in the barrel to be increased without increasing the dimensions of said barrel. Moreover, the presence of the additional weight in the vicinity of the axis of rotation of the barrel limits the increase in resistive torque upon the rotation of the barrel.

Advantageously, another feature of the invention relates to the additional storage element which comprises a plurality of additional target storage columns.

This advantageous characteristic allows the number of targets inside the barrel to be significantly increased by stacking the targets. This increase also takes place without any substantive modification to the initial dimensions of the barrel.

BRIEF DESCRIPTION OF THE FIGURES

Other characteristics, purposes and advantages of this invention will be more clearly understood upon reading the following detailed description with reference to the accompanying figures, provided as non-limiting examples only and wherein.

DETAILED DESCRIPTION

Figure 1:
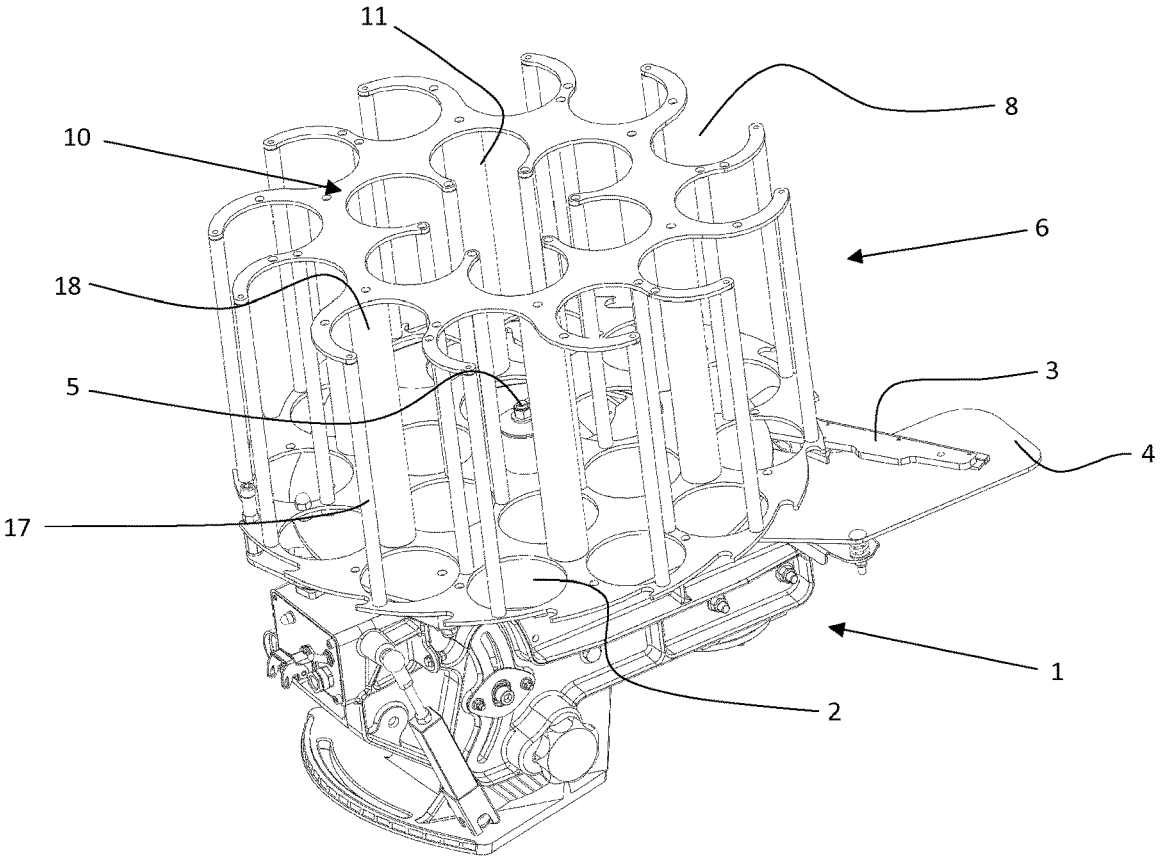
FIG. 1 shows the launching machine comprising an overall view of an improved barrel.
Figure 2:
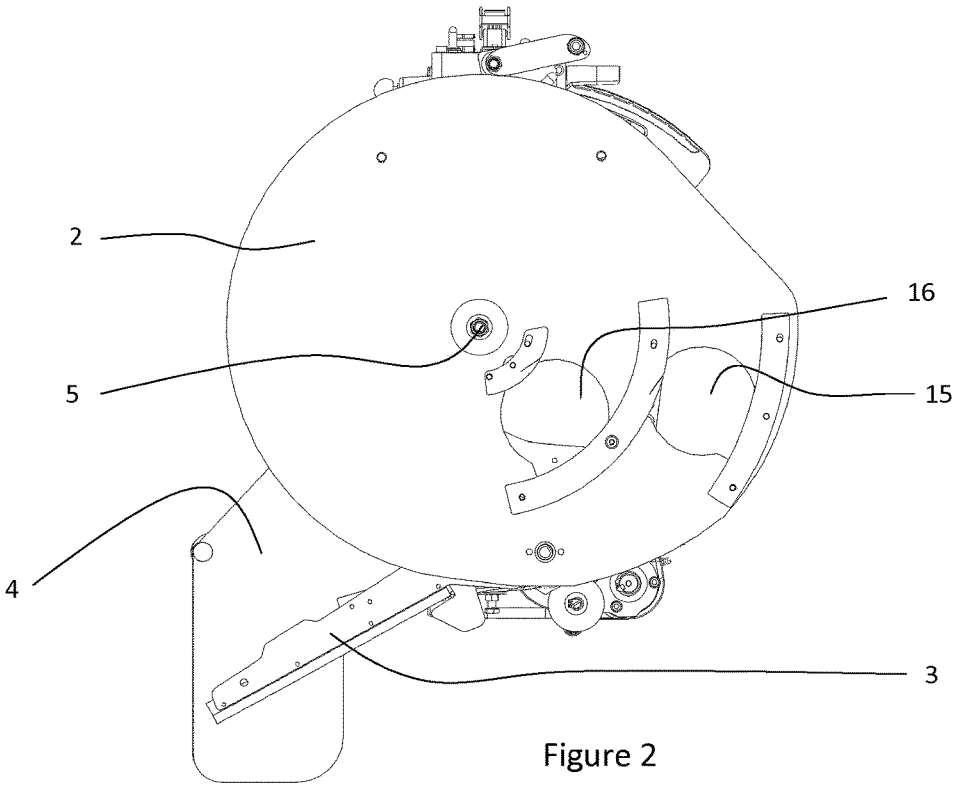
FIG. 2 is a bottom view of the mounting of the launching machine.

Before disclosing the preferred embodiments of the invention in detail with reference in particular to the figures, other optional characteristics of the invention, which can be implemented singly or in any combination thereof, are described below:

at least one portion of the plurality of additional storage columns forms an annulus concentric to the ring, and the diameter whereof is less than that of same.

the axis of rotation of the barrel is perpendicular to a plane comprising the mounting and is placed in the centre of the barrel.

each of the storage columns of the ring comprises a central axis of the storage column, at the centre of an inner space defined by a circumference of said storage column, and a ring axis perpendicularly crossing the axis of rotation of the barrel and said central axis of the storage column.

an angle $\beta$ is formed between two immediately successive ring axes according to the direction of rotation of the barrel.

each of the additional storage columns comprises a central axis of the additional column, at the centre of an inner space defined by a circumference of said additional storage column, and an additional axis perpendicularly crossing the axis of rotation of the barrel and said central axis of the additional column.

$\alpha$ is formed between two immediately successive additional axes according to the direction of rotation of the barrel.

an angle $\gamma$ is formed by the additional axis originating from an additional storage column and the ring axis originating from the storage column immediately succeeding said additional storage column.

the angle $\alpha$ is twice that of the angle $\beta$ and four times that of the angle $\gamma$.

the angle $\beta$ is strictly less than double the angle $\gamma$.

the angle $\beta$ is equal to the sum of two angles $\gamma$.

the angle $\alpha$ is 60°, the angle $\beta$ is 30° and the angle $\gamma$ is 15°.

the barrel is configured such that it successively performs, in the direction of rotation of the barrel, a first and a second angular displacements equivalent to the angle γ, followed by a third angular displacement equivalent to the angle β.

the number of additional storage columns is identical to the number of storage columns and wherein the angle α is identical to the angle β and twice that of an angle γ, said angle γ being formed by one of the additional axes and the immediately succeeding ring axis according to the main direction of rotation of the barrel.

the angle α and the angle β are 30°, and the angle γ is 15°.

the barrel is configured such that it performs, in the direction of rotation of the barrel, a succession of angular displacements equivalent to the angle γ.

the mounting comprises a first hole configured such that it allows a target originating from the ring of storage columns to pass to a launch plate and a second hole configured such that it allows a target originating from the additional target storage element to pass to the launch plate.

the barrel and the mounting are configured such that they convey a single target to the launch plate at a time.

the additional storage column comprises at least one fixed rod and one movable rod.

the target storage columns and the additional target storage columns are non-moving relative to one another.

the angle α and the angle β are not variable when the machine for launching targets is in use.

the additional storage column comprises at least one movable rod configured such that it passes from one position of the group constituted from an insertion position in which targets are inserted into the additional storage column and a locking position in which targets are locked inside the additional storage column, to another position of the group constituted from the release position in which the targets are released and the locking position in which the targets are locked inside the additional storage column.

the passage of the movable rod from the locking position to the insertion position takes place using at least one of the following means: unscrewing, folding, pivoting.

Figure 4:
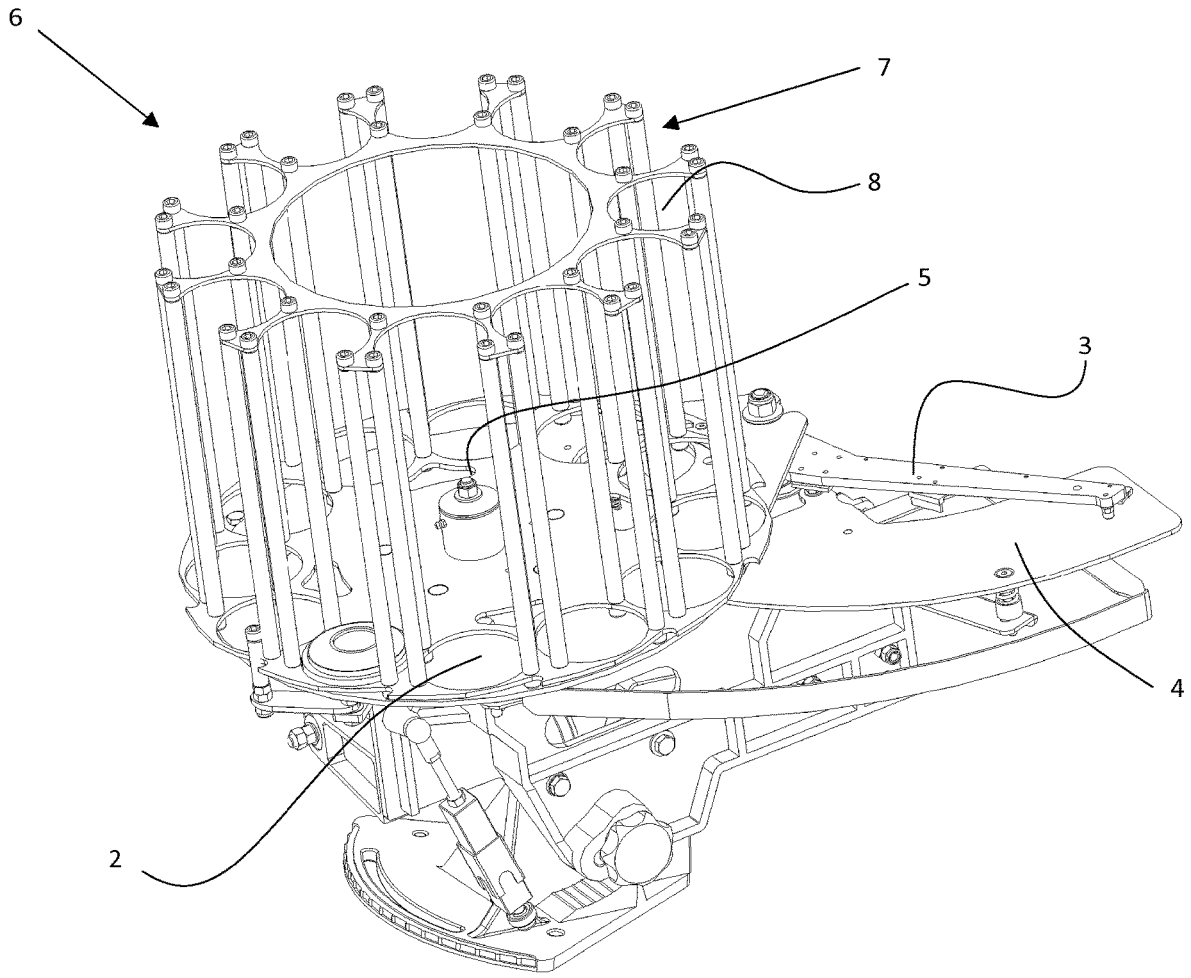
FIG. 4 shows a machine from the prior art.

The invention disclosed hereafter relates to a machine for launching targets, the barrel 6 whereof has an increased storage capacity compared to a barrel 6 of a conventional machine (FIG. 4), while maintaining overall dimensions that are identical or substantially identical to those of the conventional machine. One of the purposes of the invention is thus to improve the volumetry allocated to the storage of targets.

The machine for launching targets advantageously comprises a frame 1. Said frame 1 advantageously comprises a mounting 2 on which a barrel 6 is assembled. The launching machine further comprises a launch arm 3 and a launch plate 4. The launch arm 3 and the launch plate 4 can be supported by the frame 1.

Advantageously, the machine has a metal framework.

Advantageously, the barrel 6 is rotatably assembled about an axis of rotation 5 of the barrel 6. Preferably, the axis of rotation 5 of the barrel 6 is placed in the centre of said barrel 6.

The barrel comprises, on the one hand, a plurality of target storage columns 8 and, on the other hand, at least one additional storage element 10. Advantageously, the targets are stored by stacking inside said storage columns 8. Said stack of targets allows the number of targets stored in the barrel to be increased. Preferably, the plurality of target storage columns 8 forms a ring 7 concentric to the axis of rotation 5 of the barrel 6. The ring 7 defines an inner space of the barrel 6. Each of the storage columns 8 comprises a circumference defining a space in which the targets are positioned. In the centre of this circumference, and for each of the storage columns 8, a central axis 9 of the storage column 8 is present. Advantageously, said central axis 9 of the storage column 8 corresponds to the axis of symmetry of the storage column 8. This preferred configuration provides a central axis 9 of the storage column 8 that is perfectly centred in the middle of the space defined by the circumferences of the storage column 8. Thus, the space receiving the targets is symmetrical about the central axis 9 of the storage column 8. Advantageously, said axis is parallel to the axis of rotation 5 of the barrel 6.

In the preferred embodiment of the invention, the circumference of the storage columns 8 is interrupted. Thus, a free space is left in said circumference for the easier lateral insertion of targets. Preferably, the missing portion of the circumference is the portion that is facing outwards relative to the barrel, i.e. the portion of the circumference located the furthest from the axis of rotation of the barrel 6. In one alternative embodiment of the invention, the storage columns 8 have an uninterrupted circumference.

The number of storage columns 8 present within the barrel 6 depends on the diameter of said barrel 6 and on the size of the targets. One preferred and non-limiting embodiment of the invention comprises 12 storage columns. Another embodiment comprises 10 storage columns. However, this number of storage columns 8 is not limitative. Advantageously, all storage columns 8 of the same barrel 6 have the same diameter. Thus, the diameter of a storage column 8 advantageously lies in the range 80 mm to 130 mm and preferably in the range 105 mm to 115 mm, and is preferably equal to 112 mm. The diameter of a barrel for production with 12 storage columns 8 advantageously lies in the range 400 mm to 800 mm and preferably in the range 500 mm to 650 mm, and is preferably equal to 588 mm.

In one preferred embodiment of the invention, the target storage columns 8 comprise a movable rod 18 and can be, for example, defined by at least one fixed rod 17 and one movable rod 18. Advantageously, the storage columns 8 comprise two fixed rods 17 and one movable rod 18. In this preferred embodiment, two fixed rods are present on the circumferences of the storage columns 8 located the closest to the exterior of the barrel 6. The movable rod 18 preferably comprises means allowing it to be deployed and/or folded back relative to the barrel 6. Advantageously, said means can comprise movable elements and return springs. It goes without saying that the mobility of the movable rod 18 is not limited to this embodiment. A movable rod 18 can also be provided that is capable of being unscrewed or folded back against itself. One example embodiment is as follows: the movable element 18 can be a tube. It is interlocked, at the base thereof, in a cone-shaped element, the height whereof is low, and which is secured to the ring 7. It is positioned underneath a cap comprising a spring-assembled finger. Said finger is inserted into an orifice of the upper interface of the barrel 6. Said orifice has one narrower end that lies away from the centre 5 of the barrel 6. Pressure applied to the finger pivots the tube outwards. This frees up enough space for inserting portions of a stack of targets into the additional storage column 11. Once the additional storage column 11 is full, the tube is simply pivoted until the finger is inserted into the orifice under the action of the spring. The additional storage element 10 advantageously comprises a plurality of additional storage columns 11. Advantageously, said additional storage columns 11 are arranged so as to form an annulus that is concentric to the ring 7, the diameter whereof is less than that of said ring 7. The targets stored in said additional storage columns 11 are also stacked on top of one another. Advantageously, each of the additional storage columns 11 comprises a circumference defining an inner space. Thus, a central axis 12 of the addition column 11 is positioned in the centre of said space. Advantageously, said central axis 12 of the additional column 11 is perpendicular to the axis of rotation 5 of the barrel 6.

Similarly to the manner employed for the storage columns 8, the diameter of the additional storage columns 11 is identical to that of the storage columns 8. Moreover, the circumference of the additional storage columns 11 is also advantageously interrupted in the preferred embodiment of the invention. Nonetheless, the missing portion of the circumference of the additional storage columns 11 is situated towards the inside of the barrel 6, i.e. on the portion located the closest to the axis of rotation 5 of the barrel 6. Advantageously, an additional storage column 11 is formed by at least one fixed rod 17 and one movable rod 18. Preferably, the additional storage columns 11 are formed from two fixed rods 17 and one movable rod 18. Moreover, in the preferred embodiment of the invention, the movable rod 18 of a storage column 8 is also used to form an additional storage column 11. This characteristic allows the overall weight of the launching machine to be reduced by limiting the number of elements present in the barrel 6. Advantageously, the movable rod 18 is configured so as to free up enough space for inserting portions of a stack of targets into the additional storage column 11. This space is freed by the passage of the movable rod 18 from a target locking position to a target insertion position. In the locking position, the movable rod 18 maintains the targets stacked on top of one another. In the insertion position, the movable rod 18 frees up space in order to ease the positioning of targets inside the additional storage column 11. The term "easing the positioning of targets" is understood as procuring a larger access space than that available in the locking position.

The passage from a locking position to an insertion position and vice-versa preferably takes place using means such as, for example, screwing/unscrewing, deployment/folding, pivoting/position-holding means. Said means can also be used singly or in combination.

Once the movable rod 18 has been folded back, unscrewed or pivoted, this advantageous configuration also allows the additional storage columns 11 to be more easily supplied by sliding the targets through the storage columns 8.

The number of additional storage columns 11 present in a barrel can depend on the number of storage columns 8. Thus, the number of additional storage columns 11 is, for example, less than or equal to the number of storage columns 8.

Figure 3:
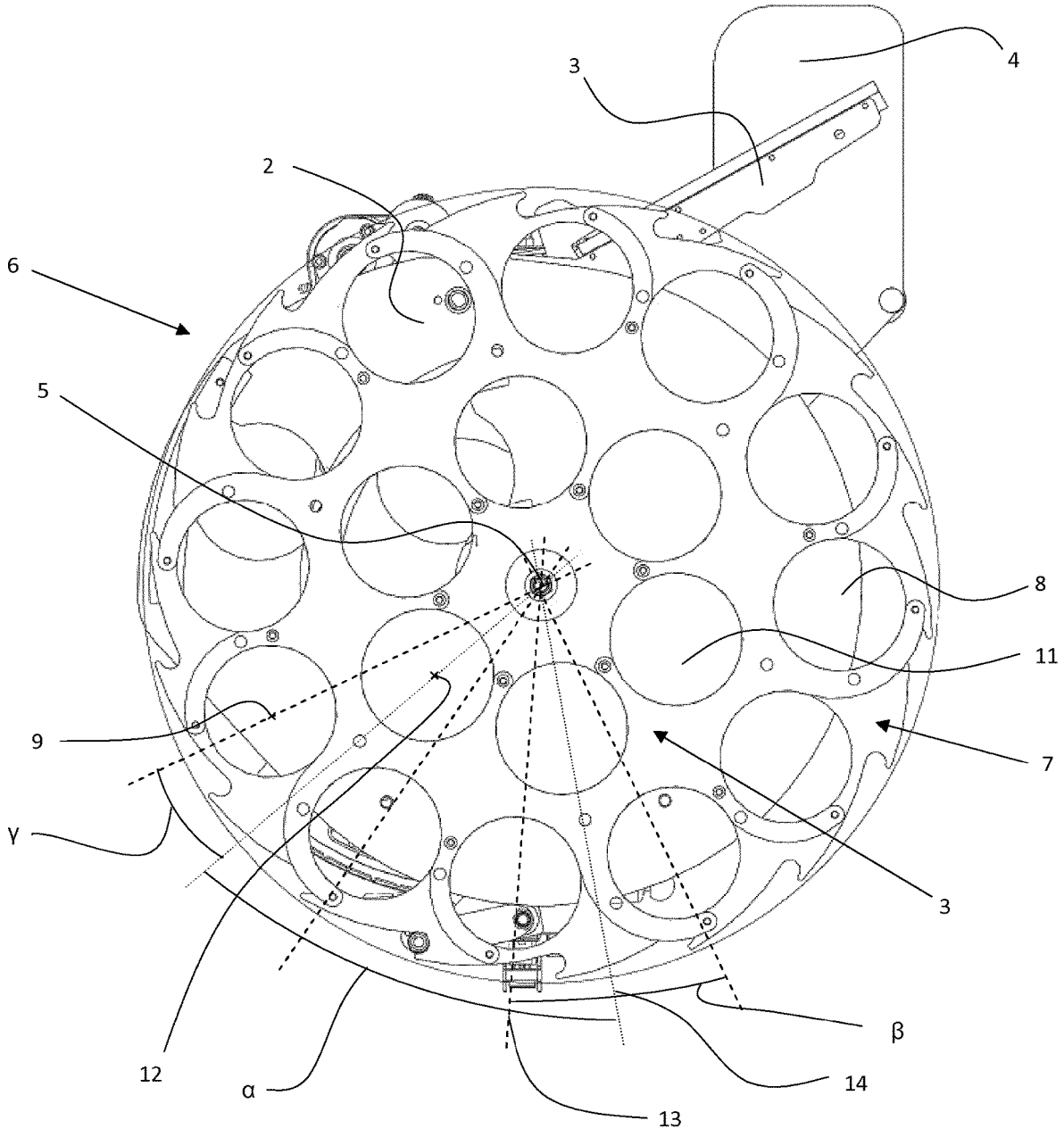
FIG. 3 shows an overhead view of the machine in one embodiment wherein the number of additional columns is less than the number of storage columns.

In the preferred embodiment of the invention (FIG. 3), the number of additional storage columns 11 is strictly less than the number of storage columns 8 and is more specifically half the number of storage columns 8.

This advantageous characteristic allows, for example with a launching machine having standard dimensions and 12 storage columns 8, the addition of 6 additional storage columns 11. Thus, for a barrel having standard dimensions and 12 storage columns 8, the increase in capacity is 50%. In real terms for this non-limiting example comprising a conventional barrel with 12 columns, the total number of targets stored in the barrel passes from 700 to 1,050.

In this preferred embodiment of the invention, the additional storage columns 11 are not aligned with the storage columns 8. One additional storage column 11 is present, on the annulus concentric to the ring 7, every two storage columns 8. We have previously stated that each of the storage column 8 comprises a central axis 9 of the storage column 8. Moreover, we have also specified that each of the additional storage columns 11 further comprises a central axis of the additional storage column 12. In this manner and in this specific embodiment, each of the additional storage columns 11 is positioned between two storage columns 8, i.e. that central axis of the additional storage column 12 is located on a straight line perpendicularly crossing the centreline of an axis perpendicularly connecting two central axes of immediately successive storage columns 9. As a whole, the purpose of the positioning of the additional storage columns 11 is to maximally optimise the space of the barrel 6. Thus, the positioning of additional storage columns 11 preferably takes place without any increase in the dimensions of the barrel 6.

Advantageously, each of the storage columns 8 further comprises a ring axis 13, and each of the additional storage columns 11 further comprises an additional axis 14. Advantageously, a ring axis 13 perpendicularly crosses the central axis of a storage column 9 and the axis of rotation 5 of the barrel 6. The additional axis 14 perpendicularly crosses the central axis of an additional storage column 9 and the axis of rotation 5 of the barrel 6.

This advantageous configuration allows angles to be defined between a plurality of said ring axes 13 and additional axes 14 and thus the relative position of each of the storage columns 8 and additional storage columns 11 to be precisely defined on the barrel 6.

Thus, two immediately successive ring axes form an angle $\beta$. On the other hand, two immediately successive additional axes form an angle $\alpha$. Advantageously, an angle $\alpha$ is twice that of an angle $\beta$. This advantageous characteristic allows a number of additional storage columns 11 equal to half the number of storage columns 8 to be positioned. More specifically, in one preferred embodiment of the invention, comprising 12 storage columns 8 and 6 additional storage columns 11, the angle $\alpha$ is equal to 60° and the angle $\beta$ is equal to 30°. It goes without saying that other angles are possible depending on the number of storage columns 8 and the number of additional storage columns 11. In another non-limiting example, wherein the barrel 6 comprises 8 storage columns 8 and 4 additional storage columns 11, the angle $\alpha$ is equal to 90° and the angle $\beta$ is equal to 45°.

An angle $\gamma$ is also defined. The angle $\gamma$ is formed from an additional axis 14 and the ring axis 13 immediately succeeding said additional axis 14, regardless of the direction of rotation of the barrel 6. The angle $\gamma$ is advantageously half that of $\beta$ or one quarter that of $\alpha$. Thus, in our preferred embodiment of the invention having 12 storage columns 8, the angle $\gamma$ is equal to 15°. In the other example having 8 storage columns 8, the angle $\gamma$ is equal to 22.5°.

In general, the barrel 6 performs successive rotations configured to convey the targets (one per column) from all columns. One rotation, performed in several steps, about 360°, corresponds to a full cycle. In this embodiment, the angular displacement of the barrel 6 at each of the rotations thereof can be different to the previous rotation. Thus, in order for the barrel 6 to supply a target from two immediately successive additional storage columns 11, i.e. for the barrel to perform an angular displacement equivalent to the angle $\alpha$, it must distribute two targets respectively originating from two storage columns 8. For this purpose, starting from a first additional storage column 11 and to move to a second additional storage column 11, the barrel 6 must perform a first angular displacement equivalent to the angle $\gamma$, in order to supply a target from a first storage column 8, then a second angular displacement equivalent to the angle β, in order to supply a target from a second storage column 8, and finally a third angular displacement equivalent to the angle γ in order to supply a target from the second additional storage column 11.

In one alternative embodiment of the invention (not shown in the figures), wherein the number of additional storage columns 11 is identical to the number of storage columns 8, said additional storage columns 11 are on the annulus concentric to the ring 7 and between two storage columns 8, i.e. perpendicularly crossing the centreline of an axis perpendicularly connecting two central axes of immediately successive storage columns 9. Thus, for example, if the number of storage columns 8 is 10, the number of additional storage columns 11 is also 10. This non-limiting embodiment allows 20 columns of targets to be provided in a launching machine having dimensions that are barely greater than those of a launching machine having 10 columns. More specifically, taking the example of a conventional barrel with 10 columns, the latter has dimensions equal to. The dimensions of a barrel having 10 storage columns 8 in addition to 10 additional storage columns 11 lie in the range 750 mm to 950 mm and preferably in the range 880 mm to 920 mm. It is clear that the increase in the number of targets (passage from 500 stored targets to 1,000 targets, equivalent to a 100% increase in the storage capacity) is not necessarily proportional to the increase in the diameter of the barrel, which remains limited. Furthermore, said diameter can be controlled by efficiently positioning, i.e. positioning with the smallest possible space therebetween, the additional storage columns 8.

In this embodiment, the angles α and β are identical and the angle γ is half that of said angles α and β. It goes without saying that said angles are determined in an identical manner to that disclosed hereinabove. In this embodiment, the angular movement of the barrel remains equal to the angle γ. Thus, for example, in a machine having 20 columns, the angles α and β are equal to 30° and the angle γ is equal to 15°.

These two alternative embodiments have several clear advantages. Firstly, these characteristics allow the target storage capacity of a launching machine to be increased by 50% to 100% without substantially modifying the overall dimensions thereof. The number of reloading operations is thus reduced. Moreover, the machines perform smaller angular displacements (generally ½ angle β). They thus generate lesser vibrations, which reduces the risks of damaging the integrity of the lowest-lying target. Finally, given that the additional targets are closer to the axis of rotation 5 of the barrel 6, the resistive torque resulting from the additional load is limited.

The mounting 2 supported by the frame 1 advantageously comprises a first and a second hole (15 and 16). Advantageously, the first hole 15 is positioned such that it allows displacement of a target originating from a storage column 8 to the launch plate 4. Respectively, the second hole 16 is positioned such that it allows displacement of a target originating from an additional storage column 11 to the launch plate 4. In one preferred embodiment of the invention, the targets are conveyed one at a time onto the launch plate in order to supply the launch arm 3 with a single target. In one alternative embodiment of the invention, the launch arm 3 is supplied, for each launch, with one target originating from a storage column 8 and with one target originating from an additional storage column 11.

In any case, the rotation of the launch arm allows the target present on the launch plate 4 to converge towards a bearing element in view of the ejection of said target, regardless of the origin of the target.

The invention is not limited to the aforementioned embodiments, but includes all embodiments compliant with the general concept thereof.

Moreover, it is clearly understood that all examples concerning machines with a specific number of storage columns 8 are non-limiting examples intended to clarify and explain the invention. Other organisations different to those of an annulus are also possible.

REFERENCES

1. Frame
2. Mounting
3. Launch arm
4. Launch plate
5. Axis of rotation
6. Barrel
7. Ring
8. Storage column
9. Central axis
10. Additional storage element
11. Additional storage column
12. Central axis
13. Ring axis
14. Additional axis
15. First hole of the mounting
16. Second hole of the mounting
17. Fixed rod
18. Movable rod

The invention claimed is:

1. Machine for launching targets comprising a frame on which a mounting is assembled, relative to which a barrel is rotatably assembled according to an axis of rotation of the barrel and in a direction of rotation, said barrel comprising a plurality of target storage columns for storing stacks of targets, the storage columns being non-moving relative to one another and arranged according to a ring defining an inner space of the barrel, wherein in that the inner space of the barrel comprises at least one additional target storage element, and the at least one additional target storage element further comprises a plurality of additional target storage columns.

2. Machine according to claim 1, wherein at least one portion of the plurality of additional storage columns forms an annulus concentric to the ring and the diameter whereof is less than that of same.

3. Machine according to claim 2, wherein the additional storage column comprises at least one movable rod configured such that it passes from one position of the group constituted from an insertion position in which targets are inserted into the additional storage column and a locking position in which targets are locked inside the additional storage column, to another position of the group constituted from the insertion position in which the targets are inserted into the additional storage column and the locking position in which the targets are locked inside the additional storage column.

4. Machine according to claim 2, wherein each of the additional storage columns comprises a central axis of the additional column, at the centre of an inner space defined by a circumference of said additional storage column, and an additional axis perpendicularly crossing the axis of rotation of the barrel and said central axis of the additional column, and wherein an angle α is formed between two immediately successive additional axes according to the direction of rotation of the barrel.

5. Machine according to claim 1, wherein the additional storage column comprises at least one movable rod configured such that it passes from one position of the group constituted from an insertion position in which targets are inserted into the additional storage column and a locking position in which targets are locked inside the additional storage column, to another position of the group constituted from the insertion position in which the targets are inserted into the additional storage column and the locking position in which the targets are locked inside the additional storage column.

6. Machine according to claim 5, wherein the passage of the movable rod from the locking position to the insertion position takes place using at least one of the following means: unscrewing, folding, pivoting.

7. Machine according to claim 5, wherein each of the additional storage columns comprises a central axis of the additional column, at the centre of an inner space defined by a circumference of said additional storage column, and an additional axis perpendicularly crossing the axis of rotation of the barrel and said central axis of the additional column, and wherein an angle α is formed between two immediately successive additional axes according to the direction of rotation of the barrel.

8. Machine according to claim 1, wherein each of the additional storage columns comprises a central axis of the additional column, at the centre of an inner space defined by a circumference of said additional storage column, and an additional axis perpendicularly crossing the axis of rotation of the barrel and said central axis of the additional column, and wherein an angle α is formed between two immediately successive additional axes according to the direction of rotation of the barrel.

9. Machine according to claim 8, wherein each of the storage columns of the ring comprises a central axis of the storage columns, at the centre of an inner space defined by a circumference of said storage column, and a ring axis perpendicularly crossing the axis of rotation of the barrel and said central axis of the storage columns, and wherein an angle β is formed between two immediately successive ring axes according to the direction of rotation of the barrel and wherein an angle γ is formed by the additional axis originating from an additional storage column and the ring axis originating from the storage column immediately succeeding said additional storage column.

10. Machine according to claim 9, wherein the angle α is twice that of the angle β and four times that of the angle γ.

11. Machine according to claim 10, wherein the angle α is 60°, the angle β is 30° and the angle γ is 15°.

12. Machine according to claim 9, wherein the angle β is less than double the angle γ.

13. Machine according to 9, wherein the barrel is configured such that it successively performs, in the direction of rotation of the barrel, a first and a second angular displacements equivalent to the angle γ, followed by a third angular displacement equivalent to the angle β.

14. Machine according to claim 9, wherein the number of additional storage columns is identical to the number of storage columns and wherein the angle α is identical to the angle β and twice that of an angle γ.

15. Machine according to claim 14, wherein the angle α and the angle β are 30° and the angle γ is 15°.

16. Machine according to 14, wherein the barrel is configured such that it performs, in the direction of rotation of the barrel, a succession of angular displacements equivalent to the angle γ.

17. Machine according to claim 1, wherein each of the storage columns of the ring comprises a central axis of the storage columns, at the centre of an inner space defined by a circumference of said storage column, and a ring axis perpendicularly crossing the axis of rotation of the barrel and said central axis of the storage columns, and wherein an angle β is formed between two immediately successive ring axes according to the direction of rotation of the barrel.

18. Machine according to claim 1, wherein the mounting comprises a first hole configured such that it allows a target originating from the ring of storage columns to pass to a launch plate and a second hole configured such that it allows a target originating from the additional target storage element to pass to the launch plate.

19. Machine according to claim 18, wherein the barrel and the mounting are configured such that they convey a single target to the launch plate at a time.

* * * * *